US006855045B2

(12) United States Patent
Laws

(10) Patent No.: US 6,855,045 B2
(45) Date of Patent: Feb. 15, 2005

(54) TUBE SURFACE CLEANING DEVICE

(76) Inventor: Randy D. Laws, 415 Tavern Hill Rd., Jonesborough, TN (US) 37659

( * ) Notice: Subject to any disclaimer, the term of this patent is extended or adjusted under 35 U.S.C. 154(b) by 0 days.

(21) Appl. No.: 10/348,833

(22) Filed: Jan. 22, 2003

(65) Prior Publication Data

US 2004/0142648 A1 Jul. 22, 2004

(51) Int. Cl.[7] ..... B24B 25/00

(52) U.S. Cl. ..... 451/462; 451/464; 451/465; 451/485

(58) Field of Search ..... 451/510, 415, 451/464, 465, 484, 485, 486, 357, 461, 462, 440, 441, 51; 15/104.01, 104.04; 30/94, 95, 96

(56) References Cited

U.S. PATENT DOCUMENTS 2,850,754 A * 9/1958 Davis ..... 15/220.4
3,117,401 A * 1/1964 Talley ..... 451/415
3,568,376 A * 3/1971 Slater ..... 451/439
4,825,543 A * 5/1989 Thalmann et al. ..... 30/96
5,038,525 A * 8/1991 Gardner ..... 451/439
5,058,327 A * 10/1991 Buchanan ..... 451/462
5,146,717 A * 9/1992 Shemesh et al. ..... 451/493
5,168,660 A * 12/1992 Smith ..... 451/462
5,600,862 A * 2/1997 Bleske et al. ..... 15/104.04
6,106,370 A * 8/2000 Carter ..... 451/51
6,393,645 B1 * 5/2002 Kadinger ..... 15/104.04

* cited by examiner

*Primary Examiner*—M. Rachuba

(57) ABSTRACT

A tube cleaning device having a pair of jaws pivotally mounted on a frame and having opposed abrading surfaces defining an abrasion cavity, a mandrel fixed to the frame and extending axially thru the cavity for slidably receiving a tube end to be cleaned, spring structure forcing the abrading surfaces toward each other and laterally toward the mandrel, and a rotator knob on the frame for rotating the device in either direction around a tube end positioned on the mandrel.

10 Claims, 2 Drawing Sheets

TUBE SURFACE CLEANING DEVICE

BACKGROUND OF THE INVENTION

1. Field

In the field of plumbing or pipe fitting it is common practice to abrade away oxidation, scale, and the like from the surfaces of copper or bronze tubing prior to soldering the tubing to various items such as T's, elbows, unions, or the like. If the tube surface is not properly cleaned, the solder which is to be "sweated" onto the tube and item will not form a watertight or gastight seal between the tube and item, and, in fact, will not form a joint at all in certain situations.

2. Prior Art

Heretofore many tube cleaning tools have been proposed including those described in U.S. Pat. Nos. 3,568,376; 6,106,370; 6,393,645 B1; 5,168,660; 5,058,327; and 5,146,717. Such tools have utility for many tube cleaning applications, particularly where the tube is fully accessible for cleaning and rotation of the cleaning mechanism, however, they do not function effectively in certain situations such as where a tube end is located in fairly tight quarters where it is difficult to position the tool around the tube end and then rotate the tool while maintaining a proper axial alignment of the tool and tube for uniform cleaning of the tube end.

SUMMARY OF THE INVENTION

The present tube surface cleaning device is especially useful in close quarters such as between floor joists, wherein the device is constructed to be easily slid on over a tube end and maintained in good axial alignment with the tube during the cleaning operation. The invention in one of its preferred embodiments is thus defined as a device for the purpose hereinabove described wherein, for purposes of description of the invention, the structure of the device is divided by a vertical plane and an intersecting horizontal plane, and comprises a frame means having a tube mandrel affixed thereto for slidingly receiving a work tube end and having a longitudinal axis lying substantially in the intersection of said planes, a pair of opposing abrading jaw means pivotally mounted on said frame means for pivotal motion on either side of said vertical plane toward and away from each other, spring means engaging said frame means and each jaw means and maintaining a closing force on said jaw means, a pair of tube stabilizer means affixed to said frame means and lying equidistantly to either side of said mandrel in a common plane parallel to and located below said horizontal plane, and rotative knob means affixed to said frame means and having a rotational axis substantially parallel to but offset from said longitudinal axis.

Many advantages flow from the present invention including that the device can be installed on tubing with mere fingertip action and very easily rotated by the operators palm which requires less strain on the wrist and fingers and is less tiring, can be operated by one hand on fixed pipe such as waterline mounted near an overhead floor, can be operated in close areas such as between overhead floor joists, and can be operated safely and at enhanced rotational cleaning speed.

BRIEF DESCRIPTION OF THE DRAWINGS

The invention and its advantages will be further understood from the following description and drawings wherein the figures are not drawn to scale or relative proportions and wherein.

DETAILED DESCRIPTION

Figure 1:
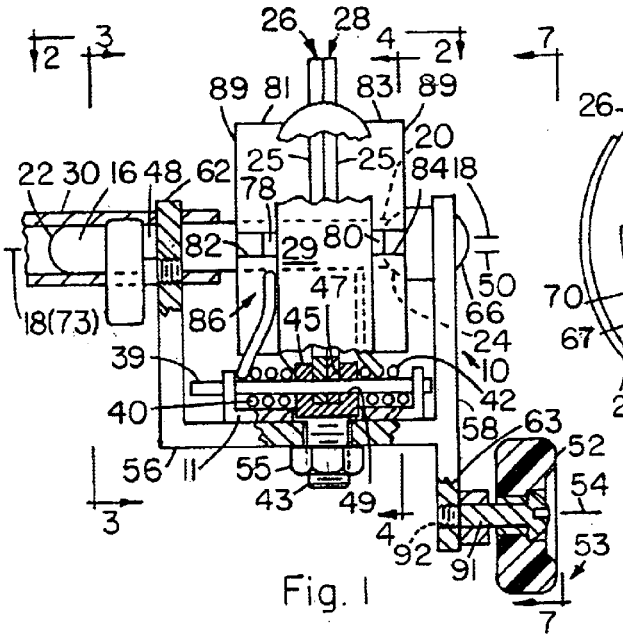
FIG. 1 is a side view of the present tube cleaner with structural portions broken away for clarity.

Referring to the drawings and with particular reference to the claims hereof, the present invention in one of its preferred embodiments is defined as a tube cleaning device comprising a frame means generally designated 10 having a vertical plane 12 and a horizontal plane 14, a work tube mandrel 16 fixed to said frame means and having a longitudinal axis 18 lying substantially thru the intersection 19 of said planes, said mandrel having a proximal end portion 20, a distal end portion 22, and a stop shoulder 24 adjacent said proximal end, a pair of opposing abrading jaw means 26,28 pivotally mounted on said frame means for pivotal motion of each jaw means toward and away from longitudinal axis 18 to close and open around the work tube 30, said jaw means having opposing abrasion surfaces 32,34 forming an abrasion cavity generally designated 36 having a median axis 73 and substantially encircling the proximal end portion 20 of said mandrel, spring means preferably comprising a pair of torsion springs 40,42 each having its reactive force generating coils wrapped around axle means 39 and its ends engaging said frame means and a jaw means and maintaining a closing force on said jaw means, a pair of tube stabilizer means 44,46 affixed to said frame means and lying equidistantly to either side of a distal portion 48 of said mandrel in a common plane 50 located below said horizontal plane 14, and rotative knob means 52 affixed to said frame and having a rotational axis 54 substantially parallel to but offset from said longitudinal axis.

Figure 3:
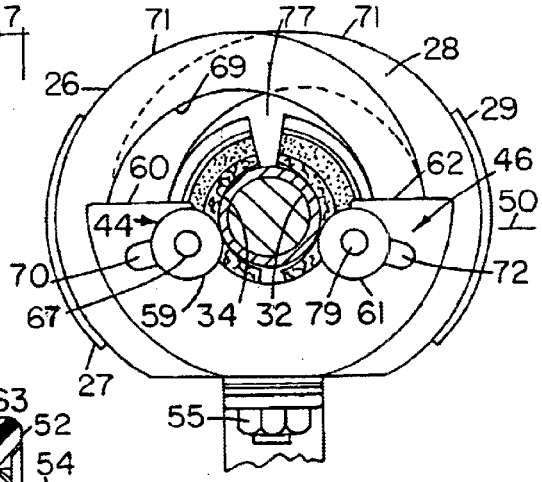
FIG. 3 is a partial cross-sectional view taken along line 3—3 in FIG. 1 wherein the abrading jaws (and abrading inserts) are shown in their operative cleaning positions.
Figure 2:
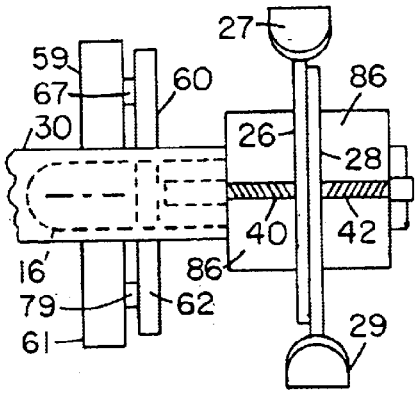
FIG. 2 is a top down view taken in the direction of line 2—2 in FIG. 1.
Figure 4:
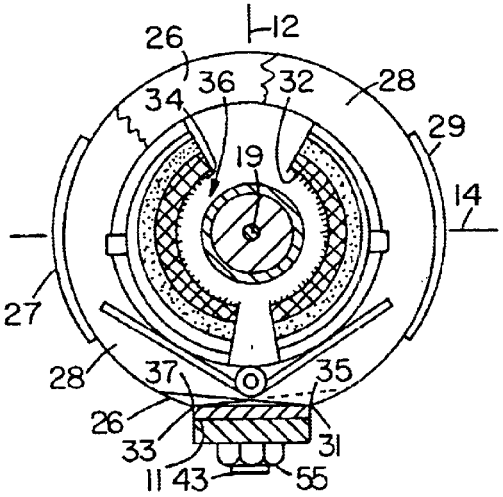
FIG. 4 is a cross-sectional view taken along line 4—4 in FIG. 1 with the abrading jaws in their full open positions.
Figure 5:
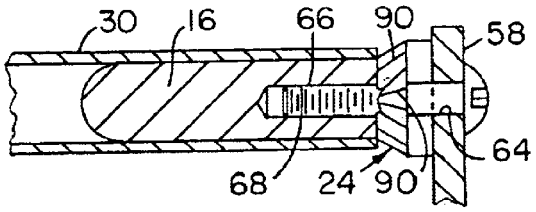
FIG. 5 is a cross-sectional view of the tube mandrel mounted on the frame means in operational position within a work tube end.
Figure 9:
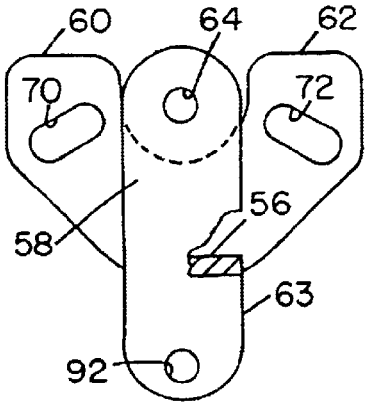
FIG. 9 is a partially sectioned end view of the isolated frame means taken in the direction 7—7 in FIG. 1.

The frame means 10 as shown most clearly in FIGS. 1, 3 and 9, preferably comprises integrally formed or connected floor means 56, mandrel support stanchion 58, tube stabilizer support arms 60,62 and knob support arm 63. Aperture 64 in stanchion 58 receives a tightening means such as a machine screw, Allen screw or the like 66 which is threaded into bore 68 in the proximal end portion 20 of mandrel 16 to tightly affix the mandrel to stanchion 58.

The stop shoulder 24 of the mandrel preferably is provided with work tube I.D. deburring edges 90 for deburring the work tube I.D. end edge by rotation of the device.

Tube stabilizers 44 and 46 may comprise non-rotative rub shoulders or the like, but preferably are contacting surfaces of small ball bearings 59,61 mounted on frame arms 60,62 by bolts 67,79 secured thru slots 70,72 in arms 60,62 respectively. Slots 70,72 preferably having their axes intersecting with axis 18 such that 44 and 46 can be adjusted in the slots for different diameter tubes.

The jaws are uniquely constructed and allow the device to have a very small and compact size which is very important for working with tubing already installed in tight quarters. Each jaw is substantially disc shaped having an outer perimetric edge 71, and a substantially centrally located opening 77 having a central axis 75 and defined by an inner perimetric edge 69.

It is noted that in the present device certain structural aspects are especially important. The first is that the diameter of the mandrel 16 is such that the mandrel and abrasion cavity 36 of the device, with the jaws fully opened, can be very easily slid on over the tube end without having to carefully fit the tube end thru an opening between tube guide means.

The second is that the jaws and frame are cooperatively constructed such that full opening of the jaws by finger and thumb squeezing pressure on pressure plates 27,29 on jaws 26,28 respectively forces edge portions 31 and 33 of jaws 26 and 28 respectively to engage portions 35 and 37 respectively of pivot base means 111 which results in cavity 36 becoming very accurately axially aligned with mandrel 16 such that sliding of the tube onto the mandrel will not impact the tube end on the edges of an abrading surface 32 or 34 and cause damage thereto.

The third is that the rotator knob 52 is constructed such that it can be readily engaged in a generally axial direction, most desirably by the palm of an operators hand and rotated about screw shaft 91 which is threaded into aperture 92 in arm 63, in either direction, to clean the tube. The axial force component 53 applied to the knob will tend to rotate the device in said vertical plane which would, were it not for stabilizers 44 and 46, skew the work tube on the mandrel and in cavity 36 and result in uneven contact of the abrading surfaces 32,34 with the work tube end portion and effect inferior tube cleaning and uneven wear of the abrading surfaces.

A further and very important fourth aspect of this stabilizer structure is that only two stabilizer surfaces as provided by 44 and 46 are utilized and are located in a common plane 50 located below horizontal plane 14. This relative positioning allows 44 and 46 to be brought laterally into contact with work tube 30 after the tube end has been slid on over mandrel 16 and thru abrasion cavity 36. Thus, the tube end can be properly positioned for cleaning without having to axially align and precisely axially move the stabilizer surfaces with respect to the work tube as the tube is being slid into cleaning position within cavity 36. As indicated above, force 53 will bring 44 and 46 into stabilizing contact with the work tube.

A preferred construction of the pivot mounting for the jaws is shown in FIG. 1 wherein a pivot base means 11 supports the ends of the axle 39 which is mounted thru an aperture 49 in the head 45 of bolt 43. A slot 47 in the bolt head receives the lower portions of the jaws, each of which is provided with bearing aperture 51 which slidably receives the axle. Tightening of nut 55 tightens the underside of the spring coils against base means 41 and in turn 41 against frame floor 56.

Figure 6:
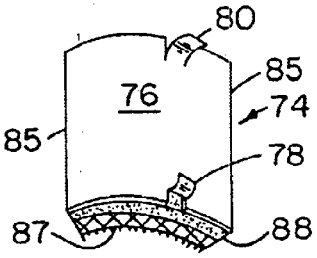
FIG. 6 is a perspective representation of a cleaning or abrading insert.
Figure 7:
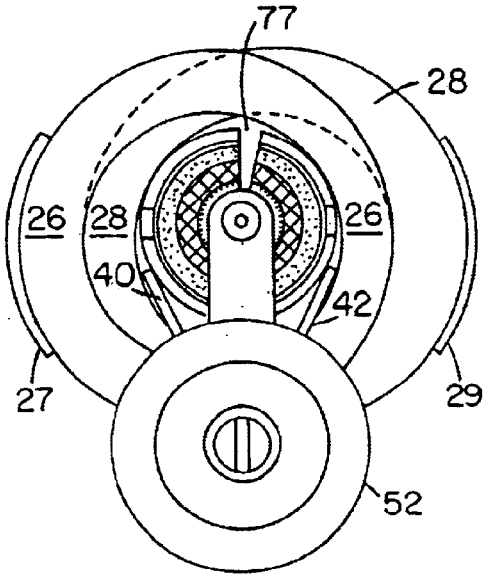
FIG. 7 is an end view taken in the direction of line 7—7 in FIG. 1.
Figure 8:
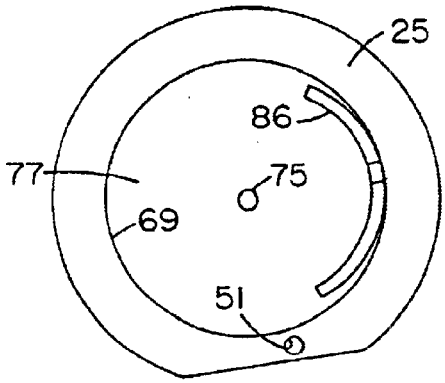
FIG. 8 is an end view of the left hand jaw of FIG. 3 in its fully opened pivoted posture.
Figure 10:
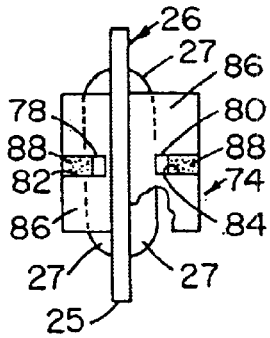
FIG. 10 is a side view of one of the jaw means (isolated) with portions broken away for clarity.
Figure 11:
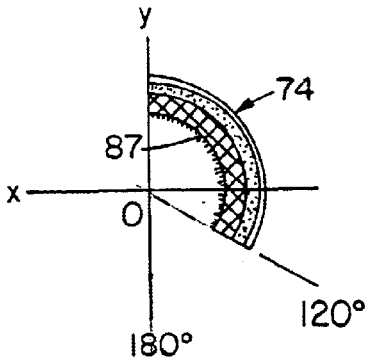
FIG. 11 shows the arc of the abrasion surfaces.

Each of the abrasion surfaces 32 and 34 is comprised preferably of an insert generally designated 74 as shown in FIG. 6. Each insert comprises a thin metal backing member 76 having mounting tabs 78 and 80 adapted to be inserted into slots 82,84 respectively in the abrasion cavity housing 86 carried by each jaw means and then bent back onto the housing as shown in FIG. 10 to secure the insert to the housing. Quick replacement of the inserts is thus made easy. It is noted that the insert holder segments 81,83 of each housing 86 lying to either side of the disc portion 25 of each jaw preferably are unequal in axial length such that when the disc portions are mounted side by side the edges 85 of the inserts will be substantially flush with the edges 89 of the holders.

The insert 74 further preferably comprises a resilient cushion layer 88 of, e.g., foamed PVC, or urethane, or the like adhesively secured to 76, and an inner abrasion pad 87 of scouring material such as fine steel wool impregnated foamed plastic, or dish cleaning abrasive pad, or Emory cloth or sandpaper, adhesively secured to cushion layer 88. It is noted that the insert and abrading surfaces extend in an arc of such length, preferably from about 120° to about 180°, such that at least most of the work tube circumference, e.g., 90% is in contact at all times with the abrasion surfaces. This large area of abrasion surface greatly reduces the degree of rotation of the cleaning device (very important in tight work areas) and the time required to properly clean the tube.

It is noted that the terms "vertical", "horizontal", "below" and the like as used herein are relative to each other and refer to the positions or postures of structural components as viewed from the drawings.

This invention has been described in detail with particular reference to preferred embodiments thereof but it will be understood that variations and modifications will be effected within the spirit and scope of the invention.

I claim:

1. A tube surface cleaning device having a vertical plane and an intersecting horizontal plane, and comprising a frame means having a tube mandrel affixed thereto for slidingly receiving a work tube end and having a longitudinal axis lying substantially in the intersection of said planes, a pair of opposing jaw means each having an abrasion surface and being pivotally mounted on said frame means for pivotal motion laterally of said vertical plane to close and open said jaw means and abrasion surfaces laterally with respect to said mandrel, spring means engaging each said jaw means and maintaining a closing force on said jaw means and abrasion surfaces, tube stabilizer means affixed to said frame means on either side of said mandrel below said horizontal plane and adapted to contact a work tube and maintain it substantially on said longitudinal axis, and rotative knob means affixed to said frame means and having a rotational axis substantially parallel to but offset from said longitudinal axis.

2. The device of claim 1 wherein two of said stabilizer means are affixed to said frame means equidistantly, one to each side of said mandrel in a common plane parallel to and located below said horizontal plane.

3. A tube cleaning device having a frame means, a vertical plane and an intersecting horizontal plane, a mandrel over which a work tube can be slid, said mandrel having a longitudinal axis substantially coincident with the intersection of said planes, a pair of substantially disc shaped jaws each having an outer perimetric edge, a substantially centrally located opening having a central axis and defined by an inner perimetric edge, and an abrasion surface on each inner perimetric edge and facing generally toward the central axis of its associated jaw, a mounting means on said frame means on which the jaws are pivotally mounted in side by side relationship whereby at least portions of the said opening overlap to accommodate both said abrasion surfaces and whereby said surfaces oppose each other and define a split abrasion cavity having a median axis, wherein said mandrel is positioned on said frame and extends axially thru said cavity, wherein spring means engages each jaw and urges the jaws toward positions wherein said central axes are out of alignment and said cavity becomes restricted and said surfaces come laterally into contact with a work tube end portion positioned over the mandrel, and hand operated rotator means is provided on said frame means for rotating the device around the work tube end.

4. The device of claim 3 wherein pressure plate means is provided on said outer perimetric edge of each jaw and directionally opposes the abrasion surfaces of its associated jaw whereby lateral simultaneous inward pressure on both pressure plates will tend to overcome the force of said spring means and bring said central axes back toward alignment wherein said abrasion cavity is in an opened condition.

5. The device of claim 4 having a vertical plane and an intersecting horizontal plane, wherein tube stabilizer means are affixed to said frame means on either side of said mandrel below said horizontal plane and are adapted to be brought laterally into contact with a work tube and maintain it substantially on said longitudinal axis of said mandrel, and rotative knob means affixed to said frame means and having a rotational axis substantially parallel to but offset from said longitudinal axis.

6. The device of claim 5 wherein two of said stabilizer means are provided and affixed to said frame means equidistantly, one to each side of said mandrel, in a common plane parallel to and located below said horizontal plane.

7. The device of claim 4 wherein said abrasion surfaces are concave, they define a substantially circular but split abrasion cavity, and wherein each abrasion surface subtends a substantially concave arc of from about 120° to about 180°.

8. The device of claim 4 wherein cooperating shoulder means are provided on said frame and on said jaws whereby as said inward pressure is continued and the jaws are being pivoted on said mounting means, a shoulder means on each jaws will engage one of the shoulder means on said frame and substantially align said longitudinal axis with said median axis and thereby provide easy axial access thru said opened abrasion cavity for a work tube end being slid on over said mandrel.

9. The device of claim 3 wherein said mandrel is provided with shoulder means for engaging the end of a work tube slid on over the mandrel to thereby properly position the tube end within said abrasion cavity.

10. The device of claim 9 wherein said shoulder means is provided with work tube I.D. deburring means.

* * * * *